United States Patent [19]

Duderstadt

[11] Patent Number: 4,944,368

[45] Date of Patent: Jul. 31, 1990

[54] LIFT TRUCK HAVING IMPROVED SINGLE MAST AND BEARING WHEEL ASSEMBLY

[76] Inventor: J. Christopher Duderstadt, 1327 Tenth Ave., San Francisco, Calif. 94122

[21] Appl. No.: 357,496

[22] Filed: May 25, 1989

[51] Int. Cl.[5] ..... B66B 9/20

[52] U.S. Cl. ..... 187/9 R; 187/95; 414/630; 212/269

[58] Field of Search ..... 187/9 R, 9 E, 95, 20; 414/490, 630, 631; 280/47.17, 47.18; 182/141; 212/267, 269

[56] References Cited

U.S. PATENT DOCUMENTS 4,421,209 12/1983 Vermette et al. ..... 187/9 R 4,632,627 12/1986 Swallows ..... 187/9 R

OTHER PUBLICATIONS

*Model EZY-150 Palletizer,* FMC Corp. of Hoopeston, Illinois 60942, 103 East Maple St.

*Primary Examiner*—Joseph J. Rolla

*Assistant Examiner*—Kenneth Noland

*Attorney, Agent, or Firm*—Skjerven, Morrill, MacPherson, Franklin & Friel

[57] ABSTRACT

A fork lift assembly is supported against a single rectangular mast by at least four separate bearing wheel assemblies. The rectangular mast is positioned relative to the fork lift assembly so that a front edge of the rectangular mast is positioned directly in line with the torque forces exerted by the load. Since the bending forces applied to the mast by the lifted load are in the direction of the edge of the mast, as opposed to the side of the mast, the mast can support a greater load. Further, the positioning of the four bearing wheel assemblies contacting each of the four sides of the mast inherently eliminate any side-to-side and twisting play in the fork lift assembly.

10 Claims, 4 Drawing Sheets

LIFT TRUCK HAVING IMPROVED SINGLE MAST AND BEARING WHEEL ASSEMBLY

FIELD OF THE INVENTION

This invention relates to lift trucks and in particular to an improved mast and bearing wheel assembly for use with a light weight electric lift truck.

BACKGROUND OF THE INVENTION

Lift trucks are typically used for stacking palletized loads. However, other types of loads may be lifted by the truck using suitable handling means. Typically, lift trucks having a vertically movable fork assembly use a double mast assembly, wherein the vertical parallel masts each contain a raceway for guiding the fork assembly vertically up and down. This double mast type design provides a high degree of forward bending resistance and pallet tilting resistance and, thus, is generally incorporated in a lift truck which must have a capability to raise and lower relatively heavy loads.

For lighter loads of, for example, 200 lbs., the mast structure need not be as rugged, and a single mast may be adequate to support the fork assembly and load.

In one embodiment of a prior art single mast lifting apparatus, the single mast incorporates a raceway for guiding the fork assembly vertically up and down the mast, similar to the raceways used in double mast type lifting devices.

One example of a single mast lifting device not using a raceway is the Model EZY-150 Palletizer from FMC Corporation of Hoopeston, Ill. This particular palletizer has a specified maximum payload of 200 lbs. and is designed to pick up a case from a conveyor belt and place the case on a pallet. The general construction of this Model EZY-150 Palletizer is shown in FIG. 1.

In FIG. 1, single mast 12 sustains a torque exerted by the weight of carton 14 grasped by lifting assembly 16. Sleeve 18 is coupled to lifting assembly 16 and essentially surrounds the rectangular single mast 12. Sleeve 18 is moved up or down single mast 12 by a drive assembly (not shown) located within support base 20 and the hollow mast 12.

In supporting the load grasped by lifting assembly 16 of FIG. 1, bearing wheel pairs 22, 24, and 26 are used to provide sleeve 18 with a low friction guiding means when moving up and down mast 12. Thus, bearing wheel pairs 22, 24, and 26 apply to mast 12 the forces resulting from the weight of lifting assembly 16 and carton 14.

As seen in FIG. 1, the force provided by bearing wheel pair 22 against side 12A of rectangular mast 12 is primarily due to torque forces in the x direction, shown in FIG. 1. Bearing wheel pairs 24 and 26 provide virtually all the force against mast 12 resulting from torque forces in the z, or downward, direction. Essentially, the torque provided lifting assembly 16 and carton 14 is such that mast 12 is resisting a force to bend mast 12 toward the location of carton 14.

Since the maximum torque to be applied to a single mast, such as mast 12, determines the dimensions, thickness, material, and cost of the mast, any modification to the mast and bearing wheel assemblies to support an increased torque without requiring a more rugged mast would greatly add to the desirability and commercial aspects of a lifting apparatus incorporating such an improved mast and bearing wheel assembly.

SUMMARY OF THE INVENTION

The present invention is a lift truck utilizing a single mast with a balanced bearing wheel system which distributes load forces to the mast more evenly and in such a way that the mast may support a greater load.

In this invention, the lifting assembly (e.g., a fork assembly) is supported against a single rectangular mast by at least four separate bearing wheel assemblies. The rectangular mast is positioned relative to the lifting assembly so that a front edge of the rectangular mast is positioned directly in line with the torque forces exerted by the load. The four bearing wheel assemblies are connected to the lifting assembly such that each of the four bearing wheel assemblies is in contact with an associated side of the mast. Since the bending forces applied to the mast by the lifted load are in the direction of the edge of the mast, as opposed to the side of the mast as in the prior art structures, the mast can support a greater load than the prior art masts and can thus be made narrower, lighter, and cheaper.

The positioning of the four bearing wheel assemblies contacting each of the four sides of the mast is such that any bending forces applied to the mast by a lifted load are distributed among all four bearing wheel assemblies and, thus, distributed among all four sides of the mast. Therefore, the bearing wheel assemblies may be made lighter and more inexpensive than prior art bearing wheel assemblies which do not similarly distribute the various torque forces.

Further, the construction of the bearing wheel assemblies and their coupling to the lifting assembly enable the lifting assembly to be more easily installed and removed, due to the elimination of the necessity to provide a bearing wheel contacting a back surface of the rectangular mast.

DETAILED DESCRIPTION

Figure 3:
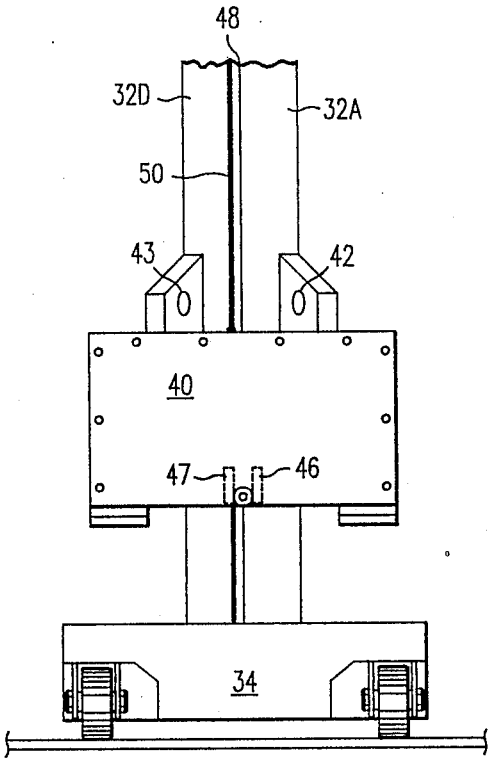
FIG. 3 is a frontal view of the embodiment of FIG. 2.
Figure 2:
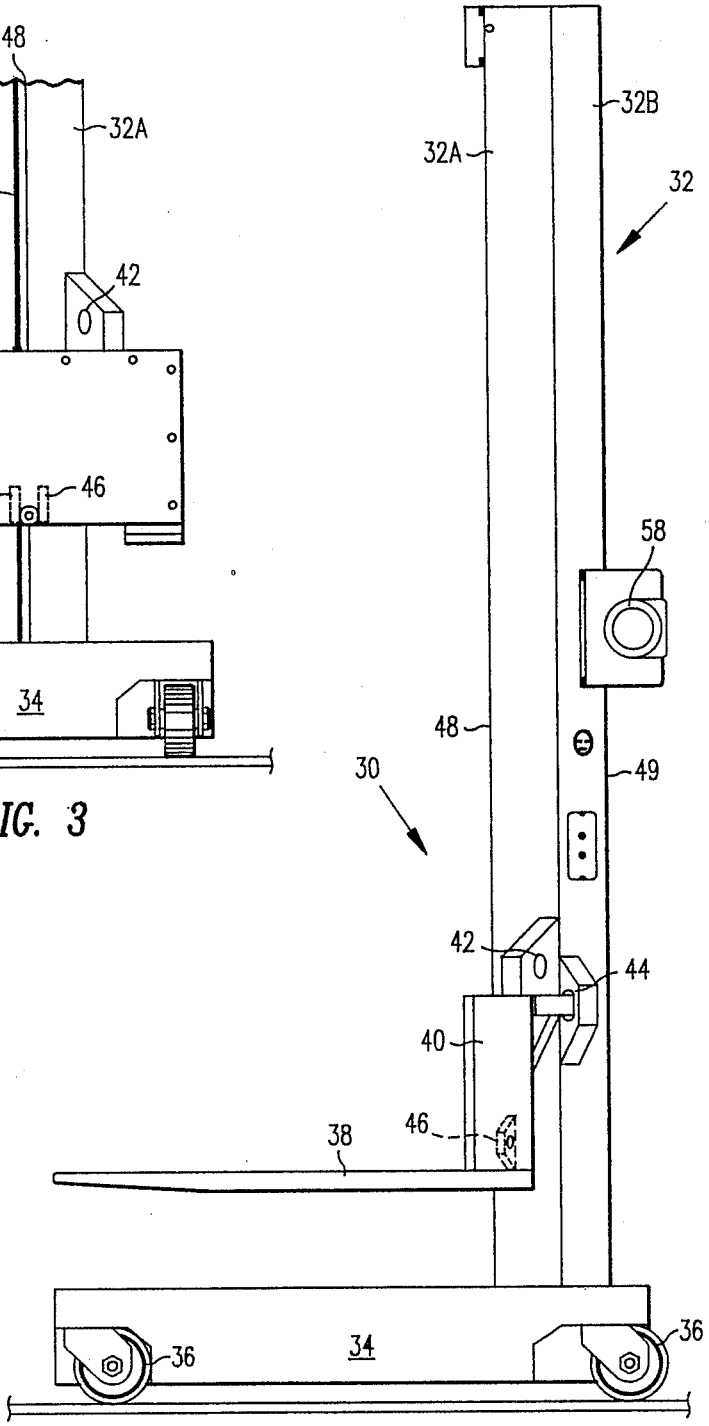
FIG. 2 is a side view of one embodiment of a lift truck incorporating the present invention.
Figure 4:
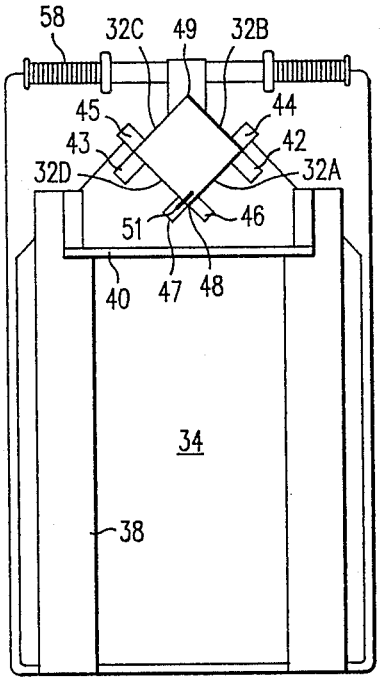
FIG. 4 is a top view of the embodiment of FIG. 2.

FIGS. 2–4 show various views of fork lift truck 30 incorporating the invention. A single mast 32 of rectangular columnar shape is held vertical by rigidly affixing mast 32 to support assembly 34 having wheels 36 mounted thereon. Horizontal fork assembly 38 is secured to lifting carriage 40 by bolts or other securing means. Fork assembly 38 may be replaced by other suitable handling means if desired. Lifting carriage 40 is movably mounted on mast 32 by the use of bearing wheel assemblies 42, 43, 44, 45, 46, and 47 such that lifting carriage 40 may be moved upward or downward along mast 32. Lifting carriage 40 is restricted from downward tilting, side-to-side horizontal movement, and sideways tilting from off-balanced loads by bearing assemblies 42–47 being in constant contact with mast 32.

In a preferred embodiment, mast 32, lifting carriage 40, and fork assembly 38 are composed of aluminum.

The specific positional arrangements of bearing assemblies 42–47 connected to lifting carriage 40 with respect to the sides of mast 32 are as follows.

Figure 5:
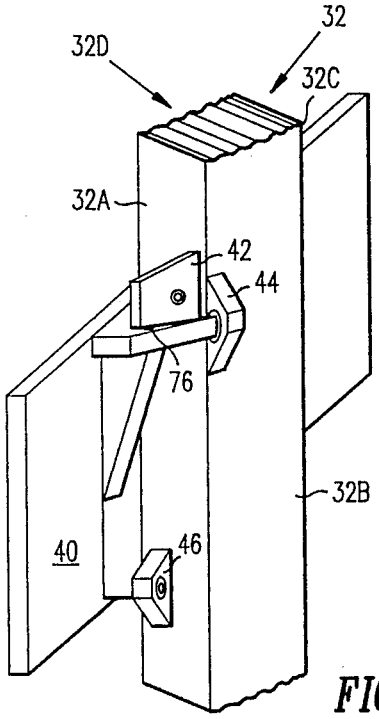
FIG. 5 is a perspective view of the bearing assemblies connected to the lifting assembly and their positional relationship with respect to the sides of the mast.

A pair of rear bearing assemblies 44 and 45, shown in FIGS. 2, 4, and 5, are connected to a top portion of lifting carriage 40 and contact rear sides 32B and 32C, respectively, of rectangular mast 32. These rear bearing wheel assemblies 44 and 45 aid in restricting lifting carriage 40 from tilting forward, moving side-to-side, and twisting due to off-balanced loads.

A pair of front bearing wheel assemblies 46 and 47, shown in FIGS. 2 and 3 in dashed outline and in FIGS. 4 and 5, are connected to a lower portion of lifting carriage 40 and contact frontal sides 32A and 32D, respectively, of rectangular mast 32. These front bearing wheel assemblies 46 and 47 also aid in restricting lifting carriage 40 from tilting forward, moving side-to-side, and twisting.

A further pair of front bearing wheel assemblies 42 and 43, shown best in FIG. 3, which are not necessary to support a downward torque by lifting carriage 40, are connected to a top portion of lifting carriage 40 and contact frontal sides 32A and 32D, respectively, of rectangular mast 32. These bearing wheel assemblies 42 and 43 aid in restricting any upward angle tilt, side-to-side movement, and twisting movement of lifting carriage 40 and, thus, ensure lifting carriage 40 remains parallel to mast 32.

Referring to FIGS. 2–5, it is clear that a load supported by fork assembly 38 is prevented from tilting fork assembly 38 and lifting carriage 40 downward by forces applied by bearing assemblies 44, 45, 46, and 47 to the four sides 32A–32D of mast 32. These forces applied to mast 32 urge mast 32 to bend in the direction of front mast edge 48 at the intersection of sides 32A and 32D. The amount of bending torque which mast 32 can support in the direction of front mast edge 48 is clearly greater than if mast 32 was positioned so that a flat side of mast 32 was facing in the direction of the bending torque. This is due to the effective width of mast 32 opposing the bending torque of a lifted load being the diagonal width of mast 32 between front edge 48 and opposite rearward edge 49 rather than the width being between opposite sides of mast 32.

Figure 1:
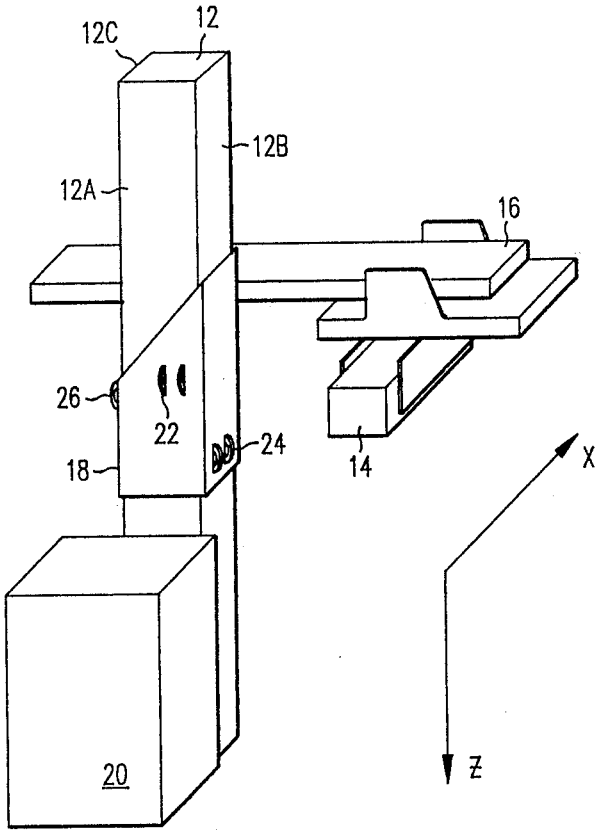
FIG. 1 (Prior Art)
FIG. 1 shows a prior art lifting device incorporating a single mast.

Further, since at least four bearing wheel assemblies 44, 45, 46, and 47, contacting all four sides of mast 32, are distributing the downward bending force to mast 32 exerted by a load supported by fork assembly 38, the four bearing wheel assemblies 44–47 act together to firmly restrict any side-to-side and twisting movement of lifting carriage 40 and fork assembly 38. This results in less play in fork assembly 38 than in prior art type single mast lifting structures, such as that of FIG. 1, wherein downward torque forces are distributed by the various prior art bearing wheel assemblies to only two sides of a mast, such as sides 12B and 12C in prior art FIG. 1. For example, in the mast and bearing wheel assemblies of FIG. 1, bearing wheel pair 22 does not share the downward torque forces with bearing wheel pairs 24 and 26 and, thus, the prior art structure of FIG. 1 allows a certain amount of side-to-side play in lifting assembly 16.

FIG. 3 shows link chain 50 which is driven by a drive means, to be discussed with reference to FIG. 6, to lift or lower lifting carriage 40. A conventional electric motor and gear down means located within support assembly 34 may be used to drive chain 50.

Rotatable sprocket 51, shown in FIG. 4, supports chain 50 near the top of mast 32, and chain 50 extends through the hollow center of mast 32.

Figure 6:
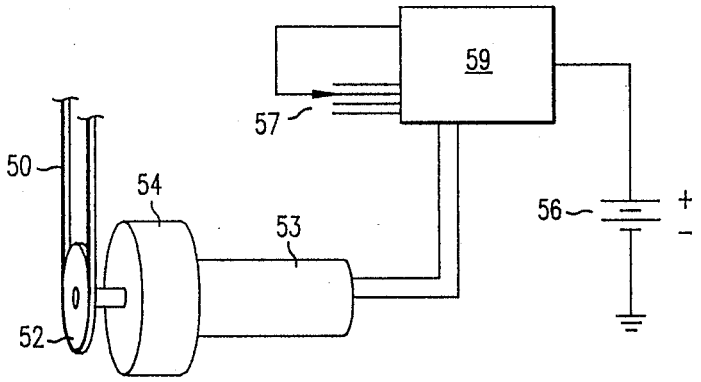
FIG. 6 is a schematic diagram of the drive means, located in the support base of the lift truck, for lifting and lowering the lifting assembly.

In one embodiment of a drive means, shown in FIG. 6, chain 50 is driven by drive sprocket 52. Drive sprocket 52 is rotated by drive motor 53 via gear down means 54. Drive motor 53 is driven by a battery supply 56, and voltage to drive motor 53 is controlled by any well known type switch means 57, located proximate to lift truck handles 58, shown in FIGS. 2 and 4, actuated by a user. In a preferred embodiment, regulator means 59 is connected between drive motor 53 and battery supply 56 and is controlled via switch means 57 to apply a regulated voltage to drive motor 53 to enable a variable upward or downward speed of lifting assembly 40.

In a preferred embodiment, any slack in chain 50 below lifting assembly 40 is taken up by a spring (not shown) connected in parallel with a number of chain links.

Figure 7:
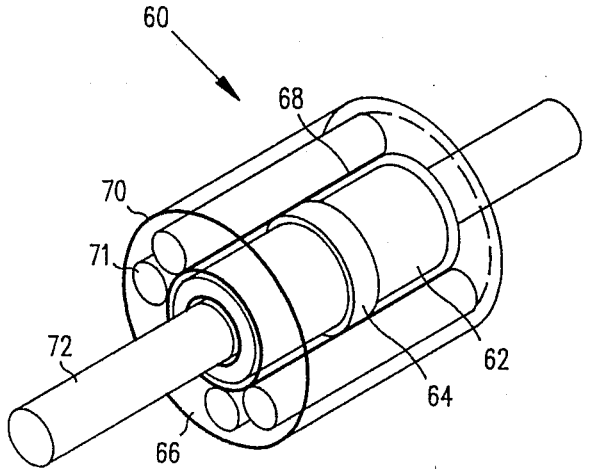
FIG. 7 is a see-through perspective view of a bearing wheel and bushing within the bearing assemblies of FIGS. 2–5.

A preferred embodiment of the construction of bearing wheel assemblies 42–47 is shown in FIG. 7. Bearing wheel assembly 60 comprises central bushing 62 having a raised portion 64 around a center section of bushing 62, wherein this raised portion 64 frictionally supports roller bearing 66. Roller bearing 66 comprises an inner ring 68 which is frictionally secured to raised portion 64. Outer ring 70 of roller bearing 66 freely rotates about inner ring 68 via roller elements 71 situated between and retained by outer ring 70 and inner ring 68. Roller bearing 66 may be any one of a number of conventional roller bearings having an inner diameter sized to snugly fit around raised portion 64 of bushing 62. Raised portion 64 enables roller bearing 66 to have a certain amount of tilt play so that the surface of outer ring 70 of roller bearing 66 will be self-aligning with respect to a side of mast 32.

In one embodiment of bushing 62, bushing 62 has an outer diameter of approximately 9/16 in., with the diameter of raised portion 64 being between 19/32 in. and 10/16 in.

A bolt 72, in the case of bearing wheel assemblies 44–47, is inserted through the hollow center portion of bushing 62 and secured to lifting carriage 40. Bearing wheel assemblies 42 and 43, as shown in FIG. 5, are not secured to the top of lifting carriage 40 by bolts 72 inserted through the center of bushing 62 but are secured by separate bolts securing a bottom surface of bearing wheel assemblies 42 and 43 to lifting carriage 40. To ensure that bearing assemblies 42 and 43 are in constant contact with sides 32A and 32D to prevent any rattling due to intermittent contact of bearing wheel assemblies 42 and 43 with the sides of mast 32, a spring means 76, shown in FIG. 5, is positioned between the bottom surface of bearing assemblies 42 and 43 and the upper surface of lifting carriage 40 so that bearing wheel assemblies 42 and 43 are urged to tilt in the direction of mast 32, thereby ensuring constant contact of bearing wheel assemblies 42 and 43 with mast 32 even when a load is lifted by fork lift truck 30.

Thus, an improved mast assembly and lifting carriage bearing wheel assembly arrangement for a lift truck is disclosed along with an improved bushing for use in each bearing wheel assembly.

While the invention has been particularly shown and described with reference to the preferred embodiment thereof, it will be understood by those skilled in the art that changes in form and detail may be made therein without departing from the spirit and scope of the invention.

I claim:

1. An improved mast structure and lifting carriage bearing wheel assembly for a lifting apparatus comprising:

a rectangular mast, said rectangular mast having four edges, a front edge of said mast being formed by an intersection of first and second sides of said mast, said front edge being positioned so as to be pointed generally in a direction of a load supporting assembly connected to a lifting carriage, a first side edge of said mast being formed by an intersection of said first side of said mast with a third side of said mast, a second side edge of said mast being formed by an intersection of said second side of said mast with a fourth side of said mast, said first and second side edges of said mast being pointed in opposite directions approximately perpendicular to said direction of said front edge of said mast, and a rear edge of said mast being formed by an intersection of said third and fourth sides of said mast, said rear edge being pointed in a direction opposite to said front edge of said mast; and a set of bearing wheel assemblies connected to said lifting carriage, said set of bearing wheel assemblies comprising a first bearing wheel assembly secured to a bottom portion of said lifting carriage and contacting said first side of said mast, a second bearing wheel assembly secured to said bottom portion of said lifting carriage and contacting said second side of said mast, a third bearing wheel assembly secured to a top portion of said lifting carriage and contacting said third side of said mast, and a fourth bearing wheel assembly secured to a top portion of said lifting carriage and contacting said fourth side of said mast.

2. The mast structure and lifting carriage bearing assembly of claim 1 wherein said first, second, third and fourth bearing wheel assemblies are arranged axisymmetric with respect to said front edge of said mast.

3. The mast structure and lifting carriage bearing wheel assembly of claim 1 further comprising a fifth bearing wheel assembly secured to said top portion of said lifting carriage and contacting said first side of said mast and a sixth bearing wheel assembly secured to said top portion of said lifting carriage and contacting said second side of said mast.

4. The mast structure and lifting carriage bearing wheel assembly of claim 3 wherein said first, second, third, fourth, fifth, and sixth bearing wheel assemblies are arranged axisymmetric with respect to said front edge of said mast.

5. The mast structure and lifting carriage bearing wheel assembly of claim 4 wherein each of said bearing wheel assemblies includes a bushing for mounting a roller bearing thereon, said bushing having a raised center portion for allowing said roller bearing to have a degree of tilt play so as to enable said roller bearing to set flush against an associated side of said mast.

6. A lift truck comprising:

a support base;

a rectangular mast positioned at a rear portion of said support base, said rectangular mast having four edges, a front edge of said mast being formed by an intersection of first and second sides of said mast, said front edge being positioned so as to be pointed generally in a direction of a load supporting assembly connected to a lifting carriage, a first side edge of said mast being formed by an intersection of said first side of said mast with a third side of said mast, a second side edge of said mast being formed by an intersection of said second side of said mast with a fourth side of said mast, said first and second side edges of said mast being pointed in opposite directions approximately perpendicular to said direction of said front edge of said mast, and a rear edge of said mast being formed by an intersection of said third and fourth sides of said mast, said rear edge being pointed in a direction opposite to said front edge of said mast;

a set of bearing wheel assemblies connected to said lifting carriage, said set of bearing wheel assemblies comprising a first bearing wheel assembly secured to a bottom portion of said lifting carriage and contacting said first side of said mast, a second bearing wheel assembly secured to said bottom portion of said lifting carriage and contacting said second side of said mast, a third bearing wheel assembly secured to a top portion of said lifting carriage and contacting said third side of said mast, and a fourth bearing wheel assembly secured to a top portion of said lifting carriage and contacting said fourth side of said mast; and a drive means connected to said lifting carriage for raising and lowering said lifting carriage.

7. The lift truck of claim 6 wherein said first, second, third and fourth bearing wheel assemblies are arranged axisymmetric with respect to said front edge of said mast.

8. The lift truck of claim 7 further comprising a fifth bearing wheel assembly secured to said top portion of said lifting carriage and contacting said first side of said mast and a sixth bearing wheel assembly secured to said top portion of said lifting carriage and contacting said second side of said mast.

9. The lift truck of claim 8 wherein said drive means comprises:

a drive motor;

a gear down means connected to said drive motor for driving a drive sprocket wheel;

a drive chain driven by said drive sprocket and connected to said lifting carriage for raising and lowering said lifting carriage;

a power supply; and a switch means for selectively applying power supply voltage to said drive motor.

10. The lift truck of claim 9 wherein said drive motor is located within said support base and wherein said drive chain extends up through said mast and engages a perimeter of a second sprocket wheel located at a top portion of said mast for redirecting said drive chain downward for connection to said lifting carriage.

* * * * *